US006981537B2

(12) United States Patent
Cyr et al.

(10) Patent No.: US 6,981,537 B2
(45) Date of Patent: Jan. 3, 2006

(54) TAIL FOR ATTACHING THE TRAILING EDGE OF ONE ROLL OF TAPE TO THE LEADING EDGE OF ANOTHER ROLL OF TAPE AND METHOD OF USING SAME

(75) Inventors: Gilles Cyr, Eugene, OR (US); Elvin Dalebout, Junction City, OR (US); Ronald L. Willadson, Springfield, OR (US)

(73) Assignee: Industrial Adhesives, Inc., Eugene, OR (US)

( * ) Notice: Subject to any disclaimer, the term of this patent is extended or adjusted under 35 U.S.C. 154(b) by 31 days.

(21) Appl. No.: 10/623,136

(22) Filed: Jul. 17, 2003

(65) Prior Publication Data

US 2004/0089402 A1 May 13, 2004

Related U.S. Application Data

(63) Continuation-in-part of application No. 09/963,190, filed on Sep. 25, 2001, now Pat. No. 6,596,111.

(51) Int. Cl.
*B65H 21/02* (2006.01)

(52) U.S. Cl. ..... 156/502; 156/358; 156/360; 156/459; 156/504; 242/554.4; 242/563; 242/554; 289/1.5; 289/2; 289/18.1

(58) Field of Classification Search ..... 242/554.4, 242/563, 554; 156/358, 360, 459, 504, 157; 289/1.4, 2, 18.1
See application file for complete search history.

(56) References Cited

U.S. PATENT DOCUMENTS

| | | | | |
|---|---|---|---|---|
| 2,766,811 | A * | 10/1956 | Armelin et al. | 156/504 |
| 2,987,108 | A * | 6/1961 | Kilmartin | 156/504 |
| 3,030,043 | A * | 4/1962 | Pinkham | 242/554.4 |
| 4,010,911 | A * | 3/1977 | Heitmann | 242/553 |
| 4,046,614 | A * | 9/1977 | Zahn et al. | 156/353 |
| 6,325,324 | B1 * | 12/2001 | Getz et al. | 242/556.1 |

* cited by examiner

*Primary Examiner*—Linda Gray
(74) *Attorney, Agent, or Firm*—Chernoff, Vilhauer, McClung & Stenzel, LLP

(57) ABSTRACT

A tape splicing mechanism joins the tail of one tape to the leading edge of another tape. A frame defines a passageway along which the tape passes. A pair of arms rotatably attached to the frame have projecting posts and rotate between a first position where the posts are closer to the pathway and a second position where they are further from the pathway. The arms are urged toward the first position and a catch mechanism holds them in the second position until released by a release mechanism when a release indicia in the first tape passes. The leading edge of the second tape is looped around the first tape to form a loose knot and is tied to the post on each side of the first tape. When the arms are released they move to the second position and tighten the knot.

8 Claims, 9 Drawing Sheets

80

122
118
120
82
112
90
102
102
123
111
100
100
109
106
116
116
114
110
104
108
108
104
110
114

TAIL FOR ATTACHING THE TRAILING EDGE OF ONE ROLL OF TAPE TO THE LEADING EDGE OF ANOTHER ROLL OF TAPE AND METHOD OF USING SAME

RELATED APPLICATIONS

This application is a continuation-in-part of application Ser. No. 09/963,190 filed Sep. 25, 2001, now U.S. Pat. No. 6,596,111, issued Jul. 22, 2003.

BACKGROUND AND SUMMARY OF THE INVENTION

The subject invention relates to a tail which is used to attach the trailing edge of tape from one roll to the leading edge of tape from another roll and to a method of using this tail to join rolls of tape together.

There are numerous applications where a continuous supply of tape material must be provided. When this occurs there needs to be a way of attaching the trailing edge of one roll of tape to the leading edge of another roll of tape without interrupting the feeding of the tape. This can be accomplished by placing a mechanical fastening device on the tape or by adhesively joining the two tapes together. An example of the latter is the system disclosed in U.S. patent application Ser. No. 09/398,153, now U.S. Pat. No. 6,325,324. Here the trailing edge of the tape on each roll is wrapped around a plate to provide an end piece which is thicker than the remainder of the tape. The leading edge of the tape on each roll has an adhesive coating applied to it. The leading edges of both rolls are then fed into a splicer block having a pair of spaced-apart pincher rollers which are separated by a distance which is greater than the thickness of two pieces of tape, but less than the thickness of one piece of tape and the end piece. Thus, when the tape from one of the rolls is pulled through the splicer block, as the tailing end of that roll passes through the pincher rollers the end piece is squeezed against the adhesive at the leading edge of the tape from the other roll, and the two pieces of tape are joined. While simple and inexpensive, this system does not always cause the two pieces of tape to be joined. Because the adhesive is exposed during the entire time the preceding roll of tape is being unwound, it can collect dust and other contaminants and become less adherent. In addition, in order for the adhesive to even be squeezed against the end piece it must be located precisely between the pincher rollers. If the operator does not do this correctly or if the moving tape drags the non-moving tape out of the pincher rollers the rolls will not be joined. In addition, the second roll can only be installed on the device which rotatively carries it in one direction in order that the adhesive side of the tape is facing the moving tape. If adhesive is put on both sides of the tape to make it reversible, the adhesive on the other side may very well stick to the pincher rollers enough that the short period of time the adhesive is exposed to the moving tape may not be enough to release it.

The subject invention overcomes the shortcomings and limitations of the prior art by providing a bulge in a tail that is attached to the trailing edge of the tape on each roll. This bulge has an adhesive coating on both sides. Protective elements are located on the tail on each side of the bulge in a manner that one of the protective elements covers the adhesive coating on each side of the bulge. As a result, when the tail is rolled onto a roll core the adhesive coating is protected by the protective element and will not stick to the roll core or to adjacent layers of the tail or tape. The protective element is configured such that it readily parts from the adhesive coating when the tail is unwound from the roll core.

In addition the leading edge of the tape from the second roll is wrapped around the tape from the first roll to form a loose knot. When the leading edge of the tape from the second roll is adhered to the adhesive on the bulge on the tail on the trailing edge of the second roll the knot is tightened so that the second roll becomes tied to the first roll as well.

In another embodiment the frame defines a pathway along which the tape travels. A pair of arms are rotatably attached to the frame, one on each side of the pathway. The extremities of the arms have outwardly projecting posts. The arms are movable between a first position where the posts are closer to the pathway and a second position where the posts are further from the pathway. The arms are normally biased to the second position. A catch mechanism holds the arms in the first position and can be released by a release mechanism to allow the arms to rotate back to the first position. The release mechanism releases the catches when a portion of the tape having a release indicia passes through the pathway. In operation, tape from a first roll is fed through the device. The leading edge of tape from a second roll is tied to the post on one of the arms, is looped around the first tape and passed back through the loop to form a loose knot around the first tape and then is tied to the post on the other arm. When the identifying indicia in the tail of the first tape passes through the pathway it causes the release mechanism to release the catch mechanism. The arms then rotate to the second position which tightens the loose knot in the second tape tightly onto the first tape. Continued movement of the first tape causes the knots in the second tape to pull off of the posts and the second tape is attached to the first tape.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
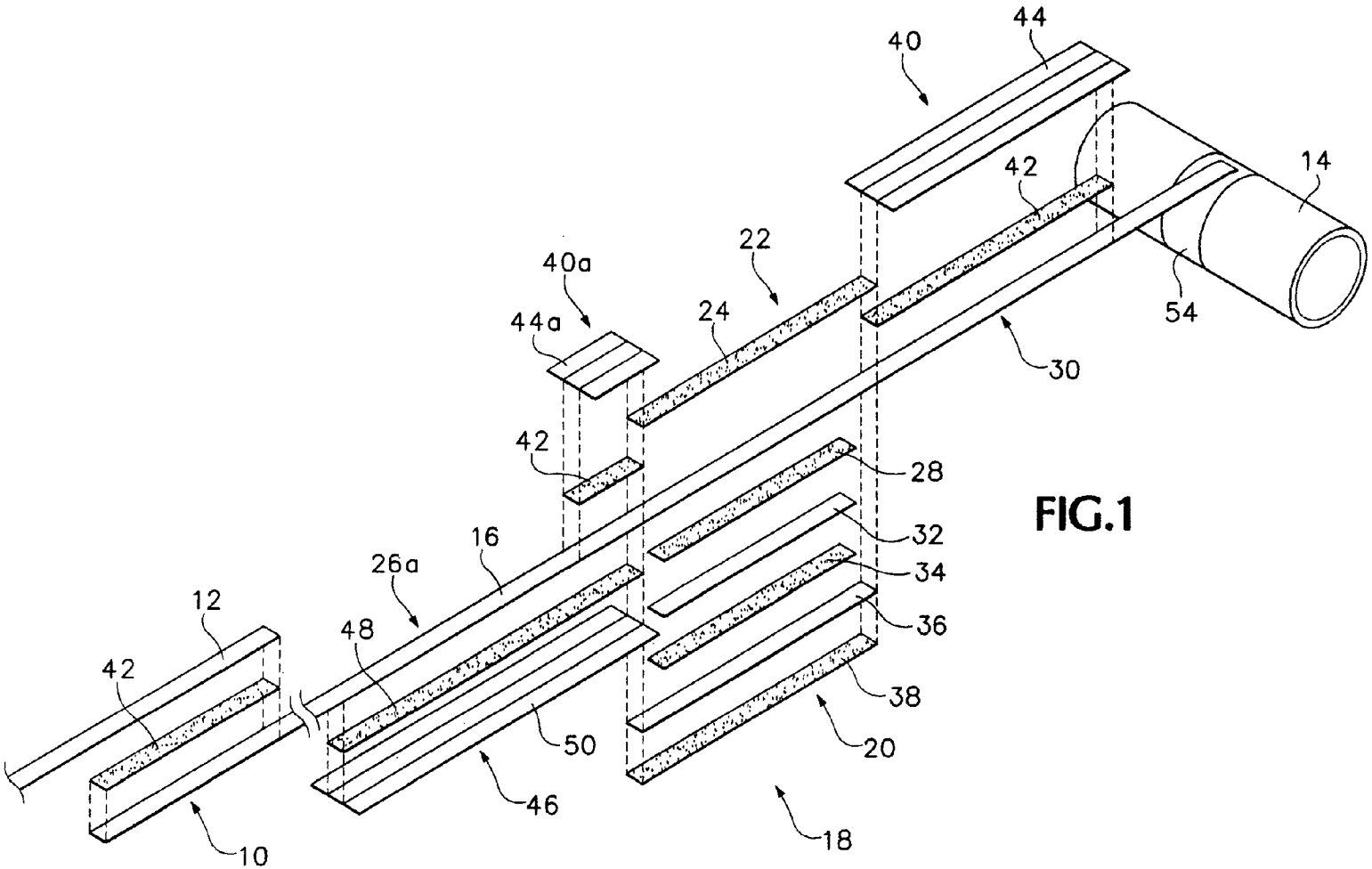
FIG. 1 is an exploded view showing a tail embodying the subject invention.

Referring to FIG. 1 of the drawings, a transfer tail 10 is attached to the trailing edge of a length of tape or tape-like material 12 which is wound onto a cylindrical roll core 14 to form a roll of tape (not shown). The purpose of the transfer tail is to automatically attach the trailing edge of the tape as it is removed from the roll to the leading edge of the tape from another roll without stopping the supply of tape to its intended application.

The tail 10 includes a tail base 16 which is made from the same or a similar material as the tape 12. The tail base preferably is 4–5 feet long, but its length is not limited. It does need to have a thickness which is similar to the thickness of the tape 12. Located on the tail base 16 near its trailing edge is a bulge 18 having a thickness which is greater than the thickness of the tail base. The bulge has an inside face 20 and an outside face 22, both of which have an adhesive coating.

In the preferred embodiment illustrated, the bulge is formed by placing a piece of double-sided tape 24, with a the protective film removed from both sides, on the first side 26 of the tail base 16. This provides the adhesive coating on the outside face 22 of the bulge. The length of the piece of double-sided tape 24 is important, as will be explained later. Another piece of double-sided tape 28, which is slightly shorter than the piece of double-sided tape 24, is placed on the second side 30 of the tail base 16 directly across from and centered over the piece of tape 24. The protective film is removed from both sides of the piece of double-sided tape 28 also. An obstruction piece 32 is placed on top of the piece of double-sided tape 28 and the obstruction piece in turn is covered with another piece of double-sided tape 34 which has the protective film removed from both sides. The obstruction piece is thicker than the tail base 16 or the double-sided tape 24, 28, 34 and it is flexible. The obstruction piece 32 and the piece of double-sided tape 34 have the same length as a piece of double-sided tape 28. A cover 36, made from the same material as the tail base and having the same length as the piece of double-sided tape 24, is then placed over the piece of double-sided tape 34. Since the cover 36 is longer than the pieces of double-sided tape 28 and 34 and the obstruction piece 32, it extends outwardly from each side of them. This permits the ends of the cover 36 to be attached to the tail base in order to make a smooth transition between the bulge and the remainder of the tail base. If the cover and the tail base are a heat-sealable material they can be heat sealed together. Otherwise they can be joined with an adhesive. Finally, another piece of double-sided tape 38, having the same length as the cover 36, is located on top of the cover. The film is removed from both sides of the piece of double-sided tape 38. This provides the adhesive surface on the inside face 20 of the bulge. Thus, there is an exposed adhesive surface on both sides of the bulge.

Located on the first side 26 of the tail base 16, towards its trailing edge from the bulge 18, is a first protective element 40. The protective element 40 will cover the exposed adhesive on the inside face 20 of the bulge when the tail 10 is wrapped onto the roll core. The length of the first protective element 40 is slightly greater than the length of the bulge 18, as will be more fully explained later. In the embodiment illustrated, the first protective element includes a piece of double-sided tape 42 with the protective film removed from both sides. Another piece of protective film 44, which is wider, is placed on top of the piece of double-sided tape 42.

In the embodiment illustrated a portion of the first protective element 40*a* is placed on the leading edge side of the bulge 18 also. The protective element 40*a* includes a piece of double-sided tape 42*a* and a piece of wide protective film 44*a*. Placing a portion of the first protective element on the other side of the bulge is not required, but it may be useful for reasons that will be described later.

Located on the second side 30 of the tail base 16, towards its leading edge from the bulge, is a second protective element 46. The second protective element 46 preferably has substantially the same length as the first protective element 40. All that is required, however, is that it be longer than the bulge. The second protective element 46 includes a piece of double-sided tape 48, with the protective film removed from both sides. This piece of double-sided tape 48 is covered with a wider piece of protective film 50.

Located on either side of the tail base 16, at its leading edge, is a piece of double-sided tape 52. The protective film is removed from this piece of double-sided tape when the tail 10 is joined to the trailing edge of the tape 12.

Figure 2:
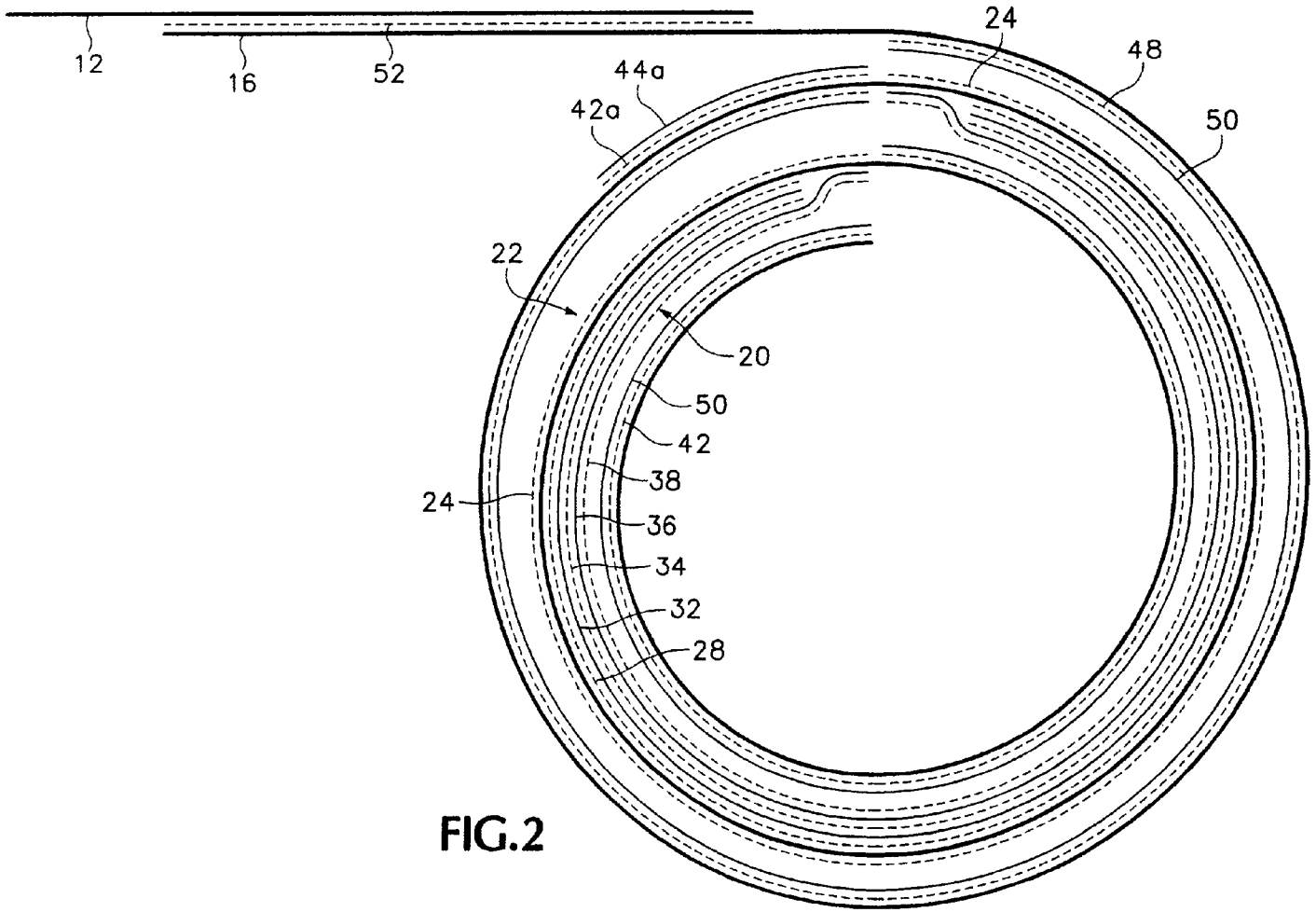
FIG. 2 is an exploded view showing how the tail of FIG. 1 is wound onto a roll core.

Once the tail 10 is attached to the trailing end of the tape 12 the tail and tape are wound on top of itself onto a roll core 14, FIG. 2. To ensure that the unprotected segment of the adhesive coating on the bulge does not stick to the roll core, a piece of double-sided tape 54 with the protective film removed from one side only is wound around the center of the roll core.

As the tail 10 is wound onto the roll core 14 the first protective element 40 faces outwardly from the roll. The length of the first protective element should be equal to or slightly greater than the circumference of the roll core. Thus, the first protective element extends entirely around the roll. As the tail continues to be wound onto the roll core, the inside face 20 of the bulge will overlie the protective element 40. Since the length of the bulge is less than the length of the first protective element the first protective element completely covers the inside face of the bulge. The protective film that is used to cover double-sided tape has a higher rate of adhesion on its inside surface than it does on its outside surface. Thus, when the tail is later unwound from the roll core the protective film will remain adhered to the protective element and will readily pull away from the adhesive layer on the bulge exposing the adhesive layer.

At this point the outside face 22 of the bulge faces outwardly from the roll. As the tail continues to be wound onto the roll the second protective element 46 overlies the outside face 22 of the bulge and the protective film covers the adhesive on this side of the bulge.

The second portion 40*a* of the first protective element is placed on the tail base 12 a spaced distance from the trailing edge of the bulge which ensures that the leading edge of the double-sided tape 24 does not extend past the end of the protective film 50.

Figure 3:
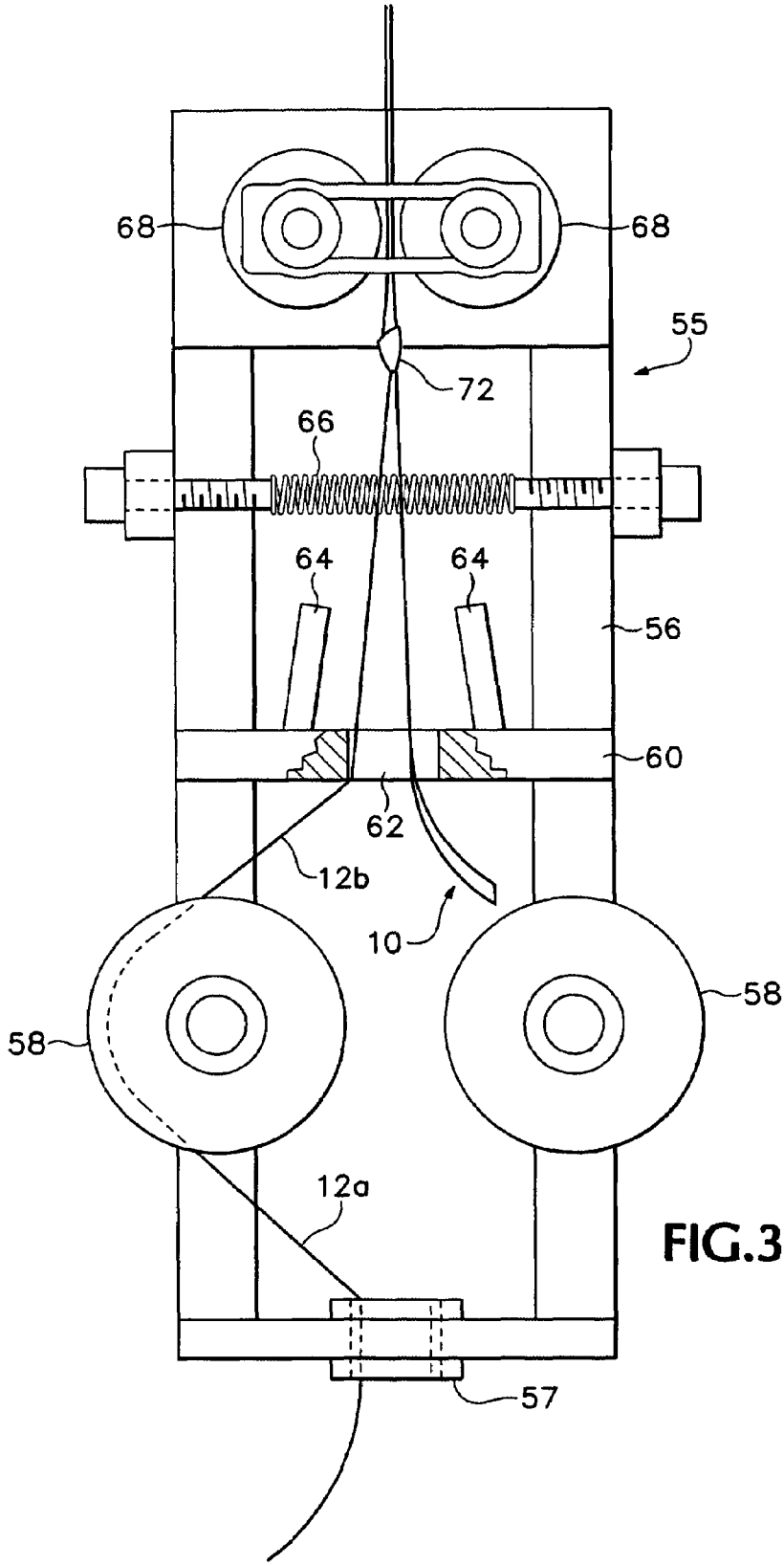
FIG. 3 is a side elevation view of a splicer mechanism showing how the trailing edge of a first piece of tape is spliced to the leading edge of a second piece of tape.

Referring now to FIG. 3, a splicer mechanism 55 that is used to join the tail 10 of one roll of tape to the leading edge of another roll includes a frame 56 having an entry passageway 57 located at its lower end. Located above the entry passageway 57 is a pair of spaced-apart guide rollers 58. Located above the guide rollers is a bridge 60 with a guide orifice 62 passing centrally through it. Extending upwardly from the bridge 60 on each side of the guide orifice is a pair of pins 64 which angle toward one another. A tape-holding device, such as a spring 66, is located above the bridge 60, and a pair of side-by-side pincher rollers 68 are located above the spring. The distance between the pinching rollers is greater than the combined width of the tape 12 but less than twice the width of the tape and the bulge 18.

The leading edge of the tape 12*a* from a first roll is fed through the passageway 57 and around one of the guide rollers 58. It is then passed through the guide orifice 62, between the coils of the springs 66, and through the pincher rollers 68. The leading edge of the tape 12*b* from a second roll is then inserted through the passageway 57, around the other guide roller 58 and through the guide orifice 62. The second tape 12*b* is then looped around the first tape and pins 64 and back through itself to form a loose half-hitch knot 70. The second tape is then placed between the coils of the springs 66 and through the pincher rollers 68. The first tape 12*a* is then pulled off of the roll by a device which applies the tape. The distance between the pinch rollers 68 allows the first tape 12*a* to run freely without effecting the stationary second tape 12*b*. The spring 66 creates a resistance against the movement of the second tape which also prevents it from moving with the first tape.

As the bulge 18 in the first tape passes through the pincher rollers, FIG. 3, the rollers pinch it against the second tape and the second tape is engaged by the adhesive surface of the bulge. Thus the second tape begins to move with the first tape 12*a*. As the second tape starts to move the loose knot 70 becomes tightened around the first tape 12*a* and a tight knot 72 is formed which mechanically attaches the leading edge of the second tape to the tail of the first tape. The first roll is then replaced with a third roll and the process is repeated.

Figure 4:
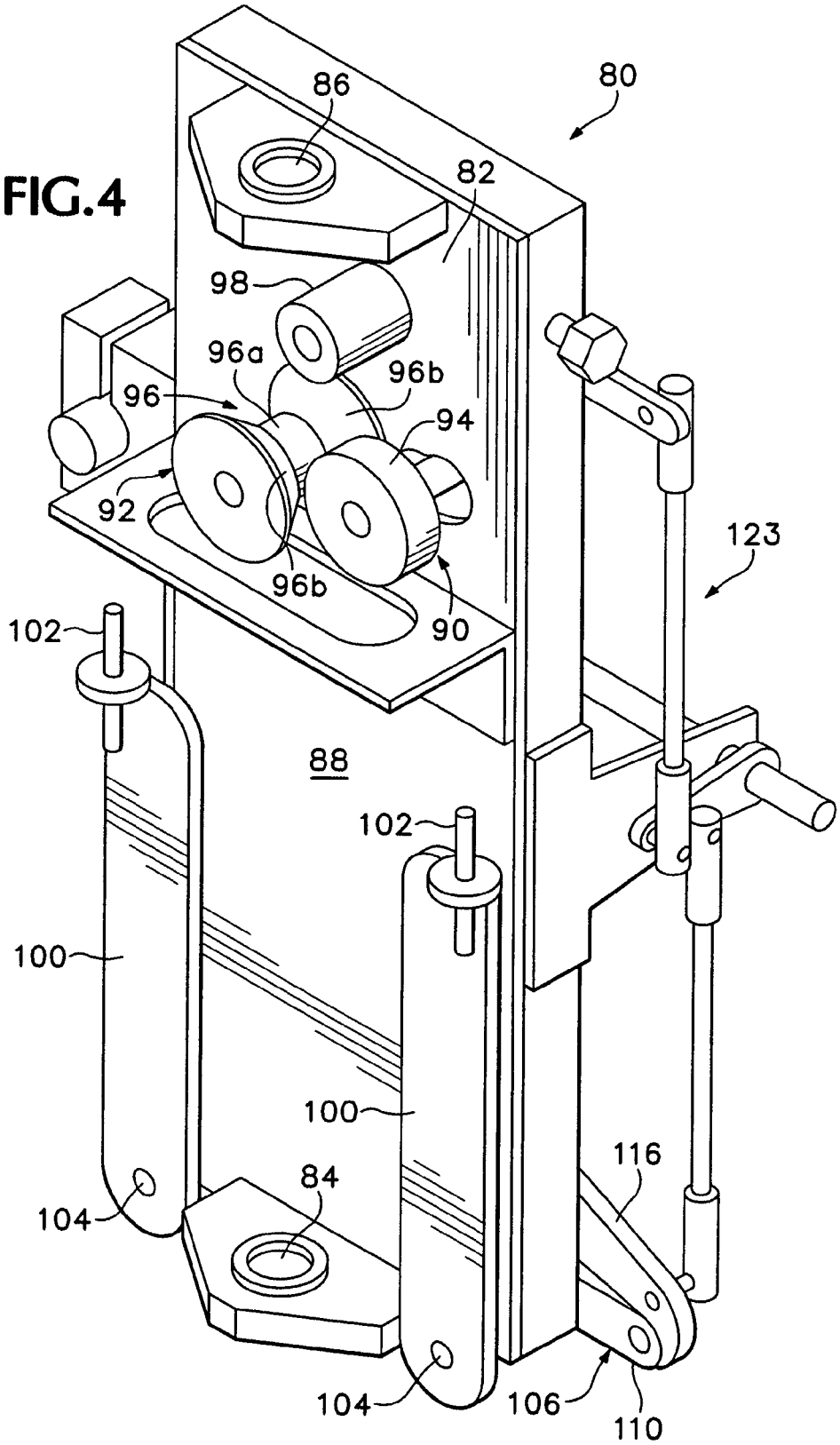
FIG. 4 is a perspective view of another splicer mechanism embodying the subject invention.
Figure 5:
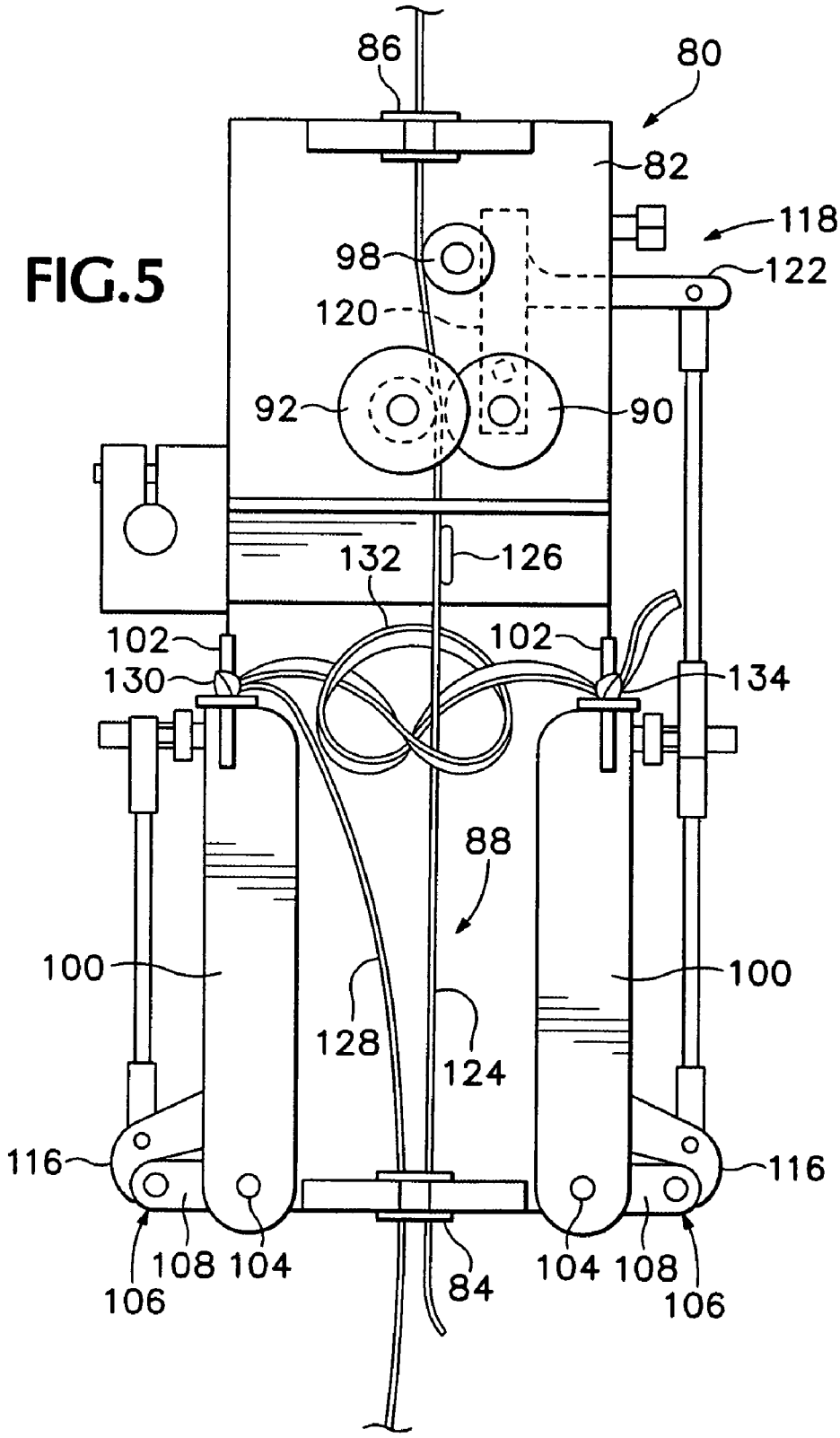
FIG. 5 is a front elevational view of the splicer mechanism of FIG. 4.
Figure 6:
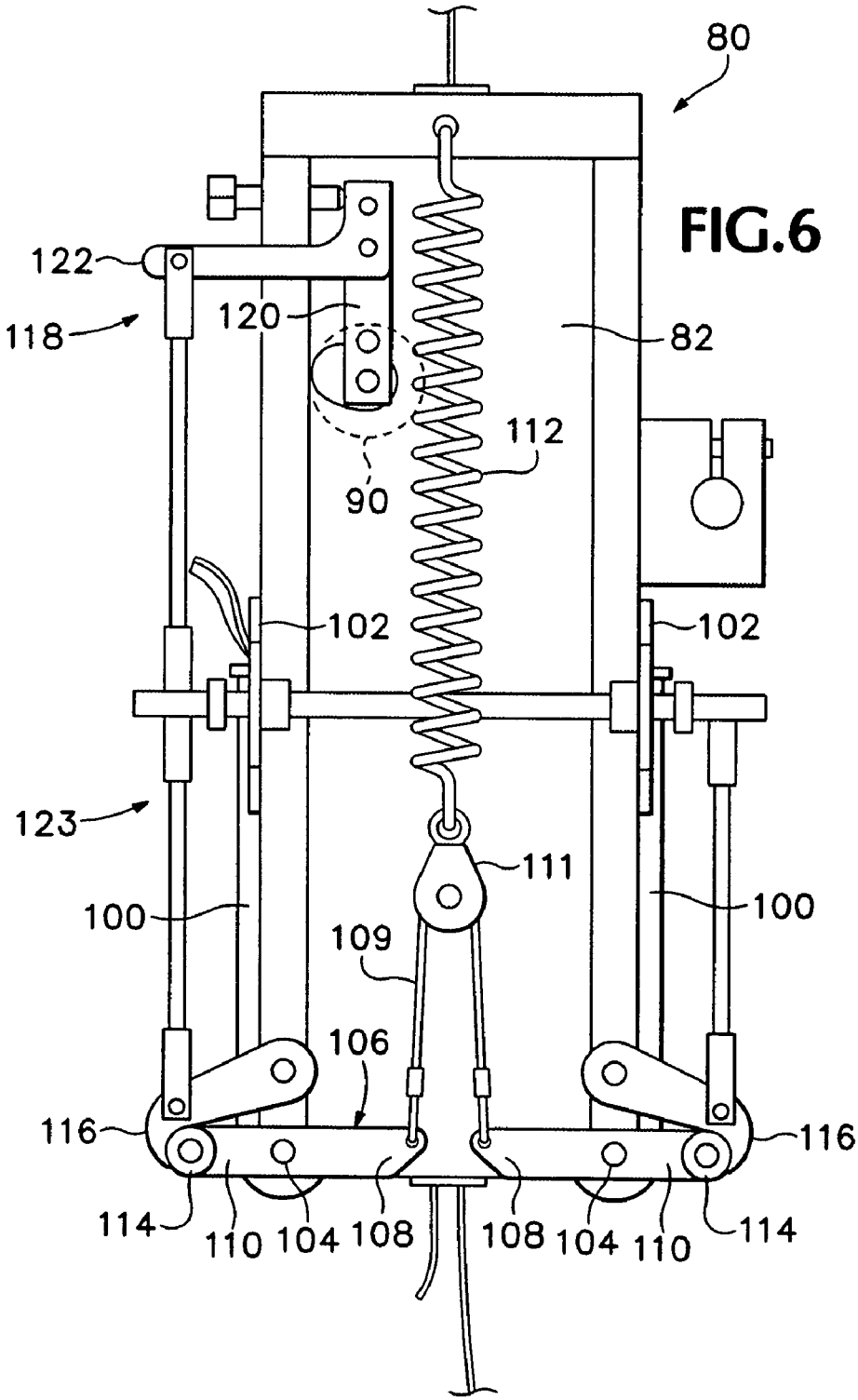
FIG. 6 is a rear view of the splicer mechanism of FIG. 4.
Figure 7:
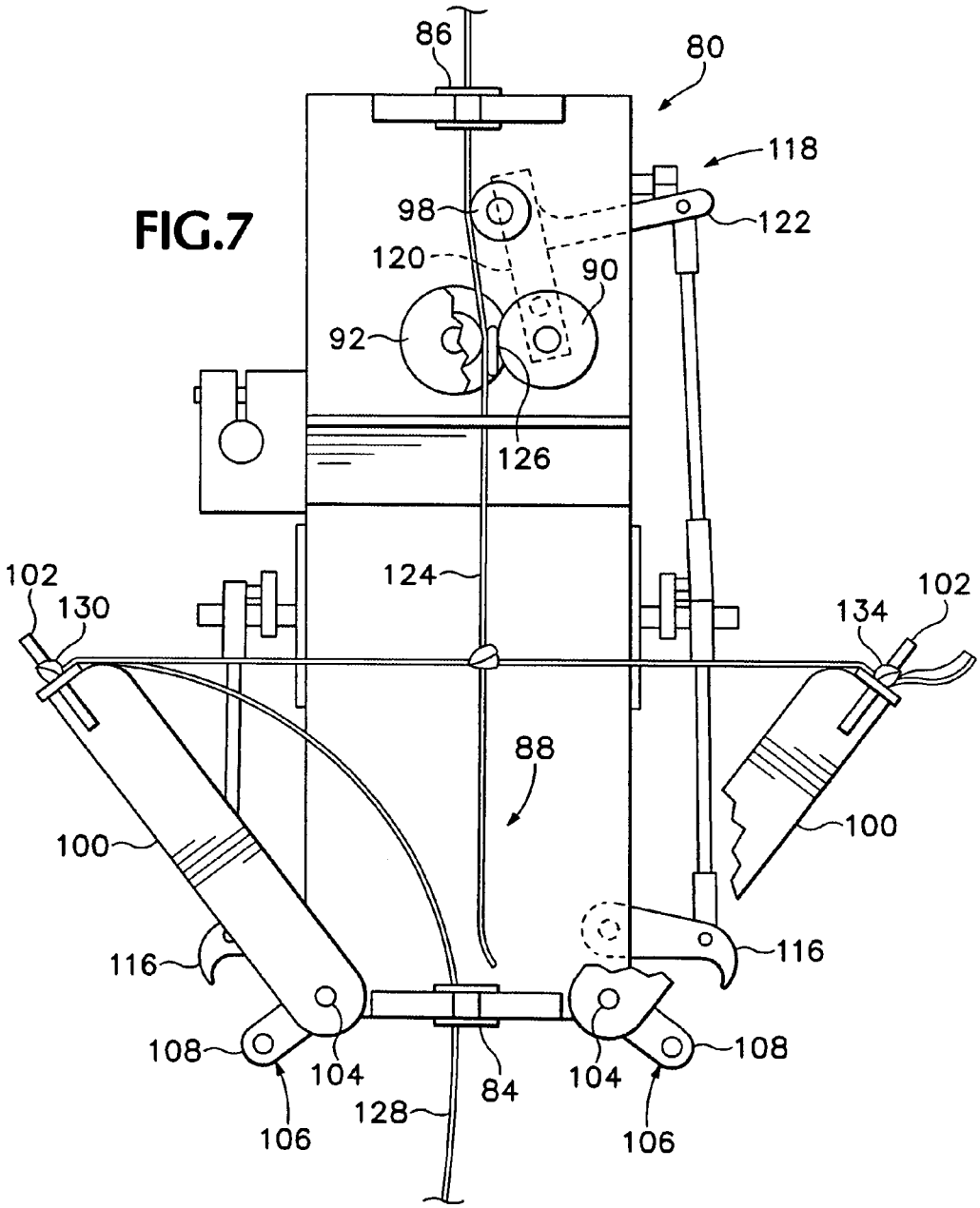
FIGS. 7 and 8 are front views of the splicer mechanism of FIG. 4 showing a sequence of operation.
Figure 8:
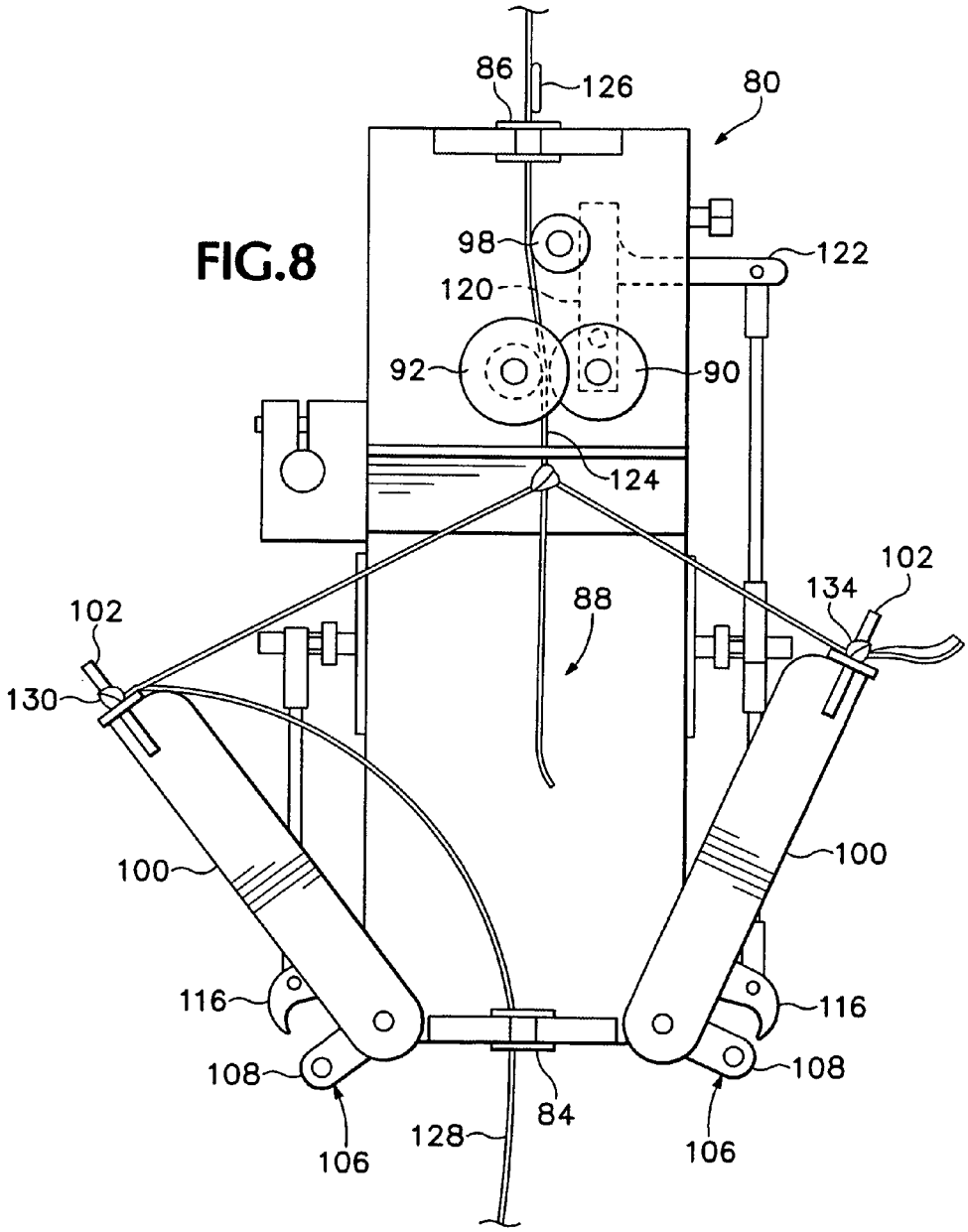

In another embodiment of the invention, shown in FIGS. 4–10, the adhesive is eliminated altogether and tightening the loose knot in the leading edge of the tape from the second roll around the tail of the tape from the first roll is the only means of attachment. Referring to FIG. 4, a splicer mechanism 80 includes a frame 82. Located at the lower edge of the frame is an entry passageway 84 and located at the upper end of the frame is an exit passageway 86. Tape fed through the upper and lower passageways travels across the frame over a defined pathway 88. Located near the upper end of the frame is a moveable roller 90 and a fixed roller 92. The tape passes between these two rollers but the rollers are separated from one another by a sufficient distance that they create negligible drag on the tape and the tape causes little, if any, rotation of the rollers under normal operating conditions. The face 94 of the moveable roller 90 is flat, and the face 96 of the fixed roller 92 has a flat center 96*a* having a width which is slightly greater than the width of the face 94 of the moveable roller 90. Located on each side of the center 96*a* are outwardly flared sections 96*b*. This shape causes the tape to remain centered between the two rollers. An idler roller 98, which is located above the rollers 90 and 92, pushes the tape toward the fixed roller 92 which also helps keep the tape centered.

Rotatably mounted at the bottom of the frame 82, on the same side as the pathway 88, are a pair of arms 100. Posts 102 extend outwardly from the extremities of the arms. The arms are moveable between a first position, FIG. 5, and a second position, FIG. 7. In the first position the arms are generally vertical and the posts are generally aligned with the tape with one post being on each side of the pathway. In the second position the arms are angled away from the tape and the posts are moved further from the pathway. The arms are mounted on one end of shafts which extend rotatably through the frame. The other end of the shafts are attached to levers 106. Thus, each lever 106 rotates with its associated arm 100. The levers are mounted on the shafts such that they are generally horizontal when the arms are generally vertical. When in this position the inner ends 108 of the levers are located close to the center of the frame, and the outer ends 110 of the levers are located outwardly from the sides of the frame.

A spring 112 extends between the top of the frame and the inner ends 108 of the levers and causes the levers to normally be oriented such that the arms are in the second position. The spring is connected to the inner ends of the levers by a cable 109 which extends from one lever through a pulley 111 which is attached to the spring to the other lever. Thus, each arm can move independently of the other arm.

Located on the outer ends 110 of the levers 106 are cylindrical bearings 114 which can be rotated. Rotatably attached to each side of the frame is a catch 116. The catches rotate between latched positions, FIGS. 4–6, and unlatched positions, FIGS. 7 and 8. In the latched positions the catches engage the bearings 114 when the arms are in their first position and prevent rotation of the levers, and thus the arms. When the catches are moved to their unlatched positions, the levers are released and the spring 112 moves the arms to the second position.

The catches are moved from their latched to unlatched positions by means, of a release mechanism 118. A bar 120 is rotatably mounted to the back side of the frame intermediate its ends. One end of the bar 118 carries the movable roller 90 and the other end is attached to an activation arm 122. When the movable roller is moved away from the fixed roller 92 the bar 112 is rotated and the extremity of the activation arm is raised. The extremity of the activation arm is connected to the catches through a linkage 124 such that when the extremity of the activation arm is raised the catches are moved out of their latched positions and the levers are released.

Figures 9, 10, 11:
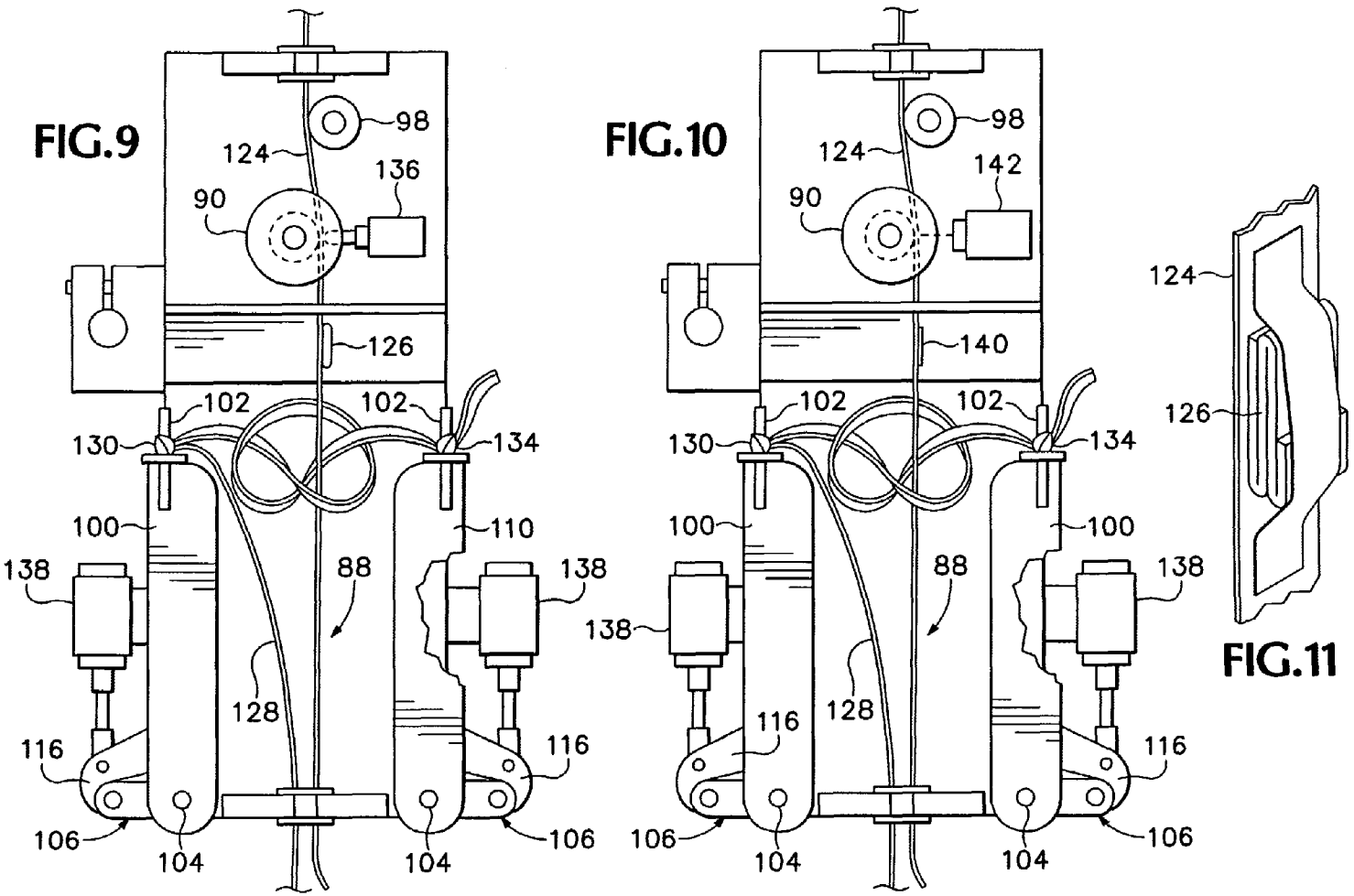
FIG. 9 is a front view of another embodiment of the invention.
FIG. 10 is a front view of yet another embodiment of the invention.
FIG. 11 is a detailed view showing how a bulge is placed in the tape.

The tape used with the splicer mechanism 80 has a bulge 126 located in its tail, FIG. 11. In use, with the arms 100 latched in the first position by the catches 116, the leading edge of tape 124 from a first roll of tape is inserted through the entry passageway 84 and out of the exit passageway 86 and is inserted into a machine which applies the tape. The leading edge of tape 128 from a second roll of tape is inserted through the entry passageway 84. The leading edge of the tape 128 is then looped around one of the posts 102 and passed back through the loop and is pulled snug to provide a slip knot 130 on this post. The tape 128 is then looped around the tape 124 and is inserted back through the loop to form a loose knot 132 around the tape 124. The tape is then looped around the other post 102 and is inserted back through the loop and is pulled snug to form a slip knot 134 on that post. Other types of loose knots could be formed around posts 102 and the tape 128 and the tape 124 could be releasably affixed to the post by other means.

When the bulge 126 in the trailing edge of the tape 124 passes between the rollers 90 and 92, the movable roller 90 is moved sideways which acts as a trigger and causes the bar 120 to rotate and raise the activation arm 122 to release the catches 116 from the bearings 114 on the levers 106. The spring 112 then causes the arms 100 to rotate and the arms pull the slip knots 130 and 134 away from the tape 124 to tighten the loose knot 132 onto the tape 124, FIG. 7. The tape 128 then moves with the tape 124, FIG. 8, and the slip knots 130 and 134 are pulled off of the posts 102 and the tape 124 is joined to the tape 128.

If one of the slip knots pulls free of its post before the other, which will almost always occur, the associated arm will have less resistance to being pulled towards the second position by the spring 112. The pulley 111 then allows this arm to move toward the first position quicker which slows down the movement of the other arm until the slip knot on it can pull free.

Referring now to FIG. 9, instead of mechanically linking the trigger element to the release mechanism, movement of the movable roller causes it to activate a proximity switch 136 which in turn causes a pair of solenoids 138 to release the catches 116. Alternatively, a load cell (not shown), measures the tension in the tape and when the tension is momentarily increased due to the bulge passing between the rollers 90, 92, the solenoids are activated by the load cell to release the catches.

In another alternative embodiment, shown in FIG. 10, rather than a bulge a patch 140, which is optically distinct from the tape, is placed in the tail of the tape. The patch 140 can be clear, reflective, or just another color than the color of the tape. A photo cell 142, located alongside the pathway 88, detects when the patch passes by it and then activates the solenoids 138.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A splicer mechanism for joining the tail of tape being fed from one roll to the leading edge of tape that will be fed from another roll, comprising:

(a) a frame, defining a pathway along which tape travels as it is being fed;

(b) a pair of arms each having a first end which is rotatably attached to said frame and a second end having a post projecting outwardly therefrom, one of said arms being located on each side of said pathway;

(c) said arms being moveable between a first position where said posts are located proximate said pathway and a second position where said posts are located further away from said pathway, said arms being normally biased toward said second position;

(d) a catch mechanism which holds said arms in said first position; and (e) a release mechanism which releases said catch mechanism when a portion of said tape containing a release indicia passes through said pathway, thereby allowing said arms to move to the second position.

2. The splicer mechanism of claim 1 wherein said release indicia is a bulge placed in said tape and said release mechanism comprises a trigger element which said tape passes, said trigger element being arranged such that it is displaced when said bulge passes thereby.

3. The splicer mechanism of claim 2 wherein said trigger element is mechanically linked to said catch mechanism.

4. The splicer mechanism of claim 2 wherein said trigger element activates a proximity switch which causes solenoids to release said catch mechanism.

5. The splicer mechanism of claim 3 or 4 wherein said trigger element is a moveable roller.

6. The splicer mechanism of claim 5 wherein said trigger element further comprises a fixed roller and said tape passes between said moveable roller and said fixed roller.

7. The splicer mechanism of claim 1 wherein said release indicia is a segment of said tape which is optically distinguishable from the remainder of said tape and said release mechanism includes an optical reader which is configured to recognize said segment.

8. A method of joining the tail of tape being fed from one roll to the leading edge of tape which will be fed from another roll comprising:

(a) providing the splicer mechanism of claim 1 wherein said release indicia is a bulge placed in said tape and said release mechanism comprises a trigger element which said tape passes, said trigger element being arranged such that it is displaced when said bulge passes thereby;

(b) placing said arms in the first position and engaging said catch mechanism;

(c) providing a first roll of tape having a bulge located in its trailing edge;

(d) feeding tape from said first roll along said pathway;

(e) providing a second roll of tape;

(f) looping the leading edge of the tape from the second roll around the post of one of said arms and back through the loop and tightening it to form a first slip knot around said post;

(g) looping the leading edge of the tape from said second roll around the tape from the first roll and back through the loop to form a loose knot around the tape from the second roll;

(h) looping the leading edge of the tape from said second roll around the post of the other arm and back through the loop and tightening it to form a second slip knot around said post;

(i) so that when said bulge in the trailing edge of the tape from the first roll engages said trigger element to release said catch mechanism and allow said arms to start rotating toward the second position, said loose knot is tightened onto said trailing edge of the tape from said first roll and said slip knots are pulled off of their respective posts.

* * * * *

UNITED STATES PATENT AND TRADEMARK OFFICE

CERTIFICATE OF CORRECTION

PATENT NO. : 6,981,537 B2
APPLICATION NO. : 10/623136
DATED : January 3, 2006
INVENTOR(S) : Cyr, Gilles, Dalebout, Elvin and Willadson, Ron It is certified that error appears in the above-identified patent and that said Letters Patent is hereby corrected as shown below:

Column 1,
Line 37, "as the tailing" should be -- as the trailing --.

Signed and Sealed this

Eighteenth Day of July, 2006

JON W. DUDAS
*Director of the United States Patent and Trademark Office*